US006783443B2

(12) United States Patent
Pedrini

(10) Patent No.: US 6,783,443 B2
(45) Date of Patent: Aug. 31, 2004

(54) POLISHING MACHINE FOR STONE MATERIALS, HAVING MULTIPLE GRINDING HEADS ALIGNED ON TWO OSCILLATING AND PARALLEL BEAMS WITH VARIABLE OFFSET

(75) Inventor: Luigi Pedrini, Carobbio degli Angeli (IT)

(73) Assignee: Pedrini S.p.A., Carobbio Degli Angeli (IT)

( * ) Notice: Subject to any disclaimer, the term of this patent is extended or adjusted under 35 U.S.C. 154(b) by 0 days.

(21) Appl. No.: 10/244,040

(22) Filed: Sep. 13, 2002

(65) Prior Publication Data

US 2003/0092359 A1 May 15, 2003

Related U.S. Application Data

(63) Continuation of application No. PCT/IT01/00119, filed on Mar. 12, 2001.

(30) Foreign Application Priority Data

Mar. 15, 2000 (IT) ..... MO2000A0046

(51) Int. Cl.[7] ..... B24B 7/00
(52) U.S. Cl. ..... 451/167; 451/163; 451/65
(58) Field of Search ..... 451/5, 65, 57, 451/24, 907, 271, 162, 163, 164, 166, 167, 168, 172, 174

(56) References Cited

U.S. PATENT DOCUMENTS 3,663,114 A 5/1972 Welsh et al.
4,914,870 A 4/1990 Toncelli
5,056,272 A * 10/1991 Battaglia ..... 451/41
5,924,911 A * 7/1999 Bralander ..... 451/5
6,086,461 A * 7/2000 Williams et al. ..... 451/65
6,315,799 B1 * 11/2001 Toniolo ..... 451/65
6,533,648 B2 * 3/2003 Drees ..... 451/182

FOREIGN PATENT DOCUMENTS

EP 0 120 588 A 10/1984
WO PCT WO 00/54932 9/2000

OTHER PUBLICATIONS

International Search Report for PCT/IT 01/00119, Jul. 5, 2001.

* cited by examiner

*Primary Examiner*—Dung Van Nguyen
(74) *Attorney, Agent, or Firm*—Graybeal Jackson Haley LLP

(57) ABSTRACT

The polishing machine for stone materials comprises: a conveyor belt for the slabs or strips to be polished, a beam made to oscillate on at least two transverse, fixed frames above the said conveyor, at least one oscillating mechanism, a number of polishing heads, aligned on the said beam and oscillating with it, a device for detecting the shape and/or dimensions of the slabs or strips, positioned upstream of the working area, a process and control calculator for the polishing machine, and has, positioned parallel to the said first beam a second beam, also equipped with a number of polishing heads aligned transversely with the polishing heads of the said first beam, and made to oscillate synchronously with it, by means of adjustable coupling devices, that enable the distance between the rows of polishing heads on the said first beam and second beam to be varied.

25 Claims, 3 Drawing Sheets

POLISHING MACHINE FOR STONE MATERIALS, HAVING MULTIPLE GRINDING HEADS ALIGNED ON TWO OSCILLATING AND PARALLEL BEAMS WITH VARIABLE OFFSET

CROSS-REFERENCE TO RELATED APPLICATIONS

This is a continuation application which claims priority from PCT/IT01/00119, published in English, filed Mar. 12, 2001, based on Italian patent application MO2000A000046, filed Mar. 15, 2000, and also claims priority from Italian patent application MO2000A000046, filed Mar. 15, 2000.

DESCRIPTION

The invention concerns: a polishing machine for stone materials, having multiple grinding heads aligned on two oscillating and parallel beams with variable offset, that is, a machine for polishing slabs and strips of materials such as marble, granite and hard stone in which the polishing heads are positioned in such a way as to make best possible use of the available space.

BACKGROUND OF THE INVENTION

Prior art comprises polishing machines with multiple polishing heads arranged in a single row on a beam oscillating transversely with respect to the direction of motion of the stone materials, transported on a conveyor. The polishing heads, equipped with abrasive scrapers (fixed or oscillating) or rollers, are made to oscillate transversely in order to obtain a working surface which is much wider than the heads themselves. The oscillating frequency is high compared to the speed of advancement of the underlying slabs or strips to enable the head to repeat the pass over the surfaced covered by the same head or the preceding head. Consequently the transverse speed of the beam on which the polishing heads are positioned needs to be high in order to pass over the entire width of the slab or strip being polished.

Furthermore, such a polishing machine needs to be very long in order to have a sufficient number of heads to achieve the desired degree of grinding and/or polishing. It is common for the successive heads to have abrasive elements with variable cutting and polishing characteristics to achieve a completely finished slab or strip at the end.

Prior art also comprises a polishing machine equipped with a shuttle with a set of two polishing heads which moves over the surface to be polished, suspended on a mobile frame: the said heads on the shuttle are positioned at an adjustable distance from one another, so that, with their transverse motion and the successive positioning of the mobile frame in a longitudinal direction, they cover the entire surface of the slab or strip to be polished, limiting the interference of the worked surfaces and extending the in a transverse direction the area covered by the two heads as a result of the adjustable distance between the two heads.

However, the working capacity of this last type of polishing machine is limited, in relation to the quantity slabs that need to be able to be produced. In fact, the successive positioning of the mobile frame effectively reduces the overall working speed of the polishing machine, moreover, the heads are positioned to perform the same polishing action over the whole surface of the slab, even with repeated passes, being subsequently adjusted to perform the final polishing of the same slab. This entails an extremely low productivity.

Such prior art may be subject to considerable improvement with a view to the possibility of making better use of available space and of obtaining a polishing machine with a high productivity.

From the foregoing emerges the need to resolve the technical problem of obtaining the maximum productivity from the polishing machine without occupying a large working area also in terms of length.

SUMMARY OF THE INVENTION

The invention resolves the said technical problem by adopting: a polishing machine for stone materials comprising a conveyor belt for the slabs or strips to be polished, a beam made to oscillate on at least two transverse, fixed supports above the said conveyor, at least one oscillating mechanism, a number of polishing heads, aligned on the said beam and oscillating with it, a device for detecting the shape and/or dimensions of the slabs or strips, positioned upstream of the working area, a process and control calculator for the polishing machine, characterised in that it has a second beam positioned parallel to the said first beam, also equipped with a number of polishing heads, transversely aligned with the polishing heads of the said first beam, and made to oscillate synchronously with it, by means of adjustable coupling devices, that enable the distance between the rows of polishing heads on the said first beam and second beam to be varied.

Adopting, in a further and preferred embodiment: a braking mechanism, kept in the locked position for the entire duration of the working phase, to ensure that the mechanical coupling between the two beams is blocked.

Adopting, in a further embodiment: the said adjustable coupling devices consisting of at least one pair of screw devices connected to each other and to the respective beams, even driven synchronously by a control transmission.

Adopting, in a further preferred embodiment: the said braking devices being activated by remote control.

Adopting, in a further embodiment: the said braking devices consisting of at least one hydraulically or pneumatically controlled actuator for each extremity of the beam.

Adopting, in a further embodiment: the said braking devices consisting of at least one electrically controlled actuator for each extremity of the beam.

Adopting, in a further preferred embodiment: the shuttle of the said first beam is equipped with guide rails for the second beam.

Adopting, in a further embodiment: the braking devices act directly on the said guide rails connecting the two beams.

Adopting, in a second embodiment: each beam translating and being adjustable with respect to an intermediate point of the shuttle for the transverse oscillation on the frames on which they are supported and blocked, by means of the said braking devices, so as to define a precise distance between the rows of polishing heads positioned on the said beams.

Adopting, in a third embodiment: both beams being able to translate directly on the said transverse frames on which they are supported; they are blocked with respect to each other by means of the said braking devices acting on elements connected to the respective beams, so as to define a precise distance between the rows of polishing heads positioned on the said beams.

The advantages obtained with the present invention are: the polishing machine has the polishing heads arranged in a more compact configuration, as the heads are positioned on two beams instead of just one; this configuration enables the overall length of the machine to be reduced in that two polishing heads work simultaneously on adjacent areas of the same slab or strip to be polished, with the same degree of finishing; the two adjacent polishing heads reduce the amplitude of oscillation required by approximately half compared that required for the single row of heads, thereby increasing productivity.

BRIEF DESCRIPTION OF THE DRAWINGS

An embodiment of the invention is illustrated, purely by way of example, in the three tables of drawings attached.

DETAILED DESCRIPTION OF THE INVENTION

Figure 1:
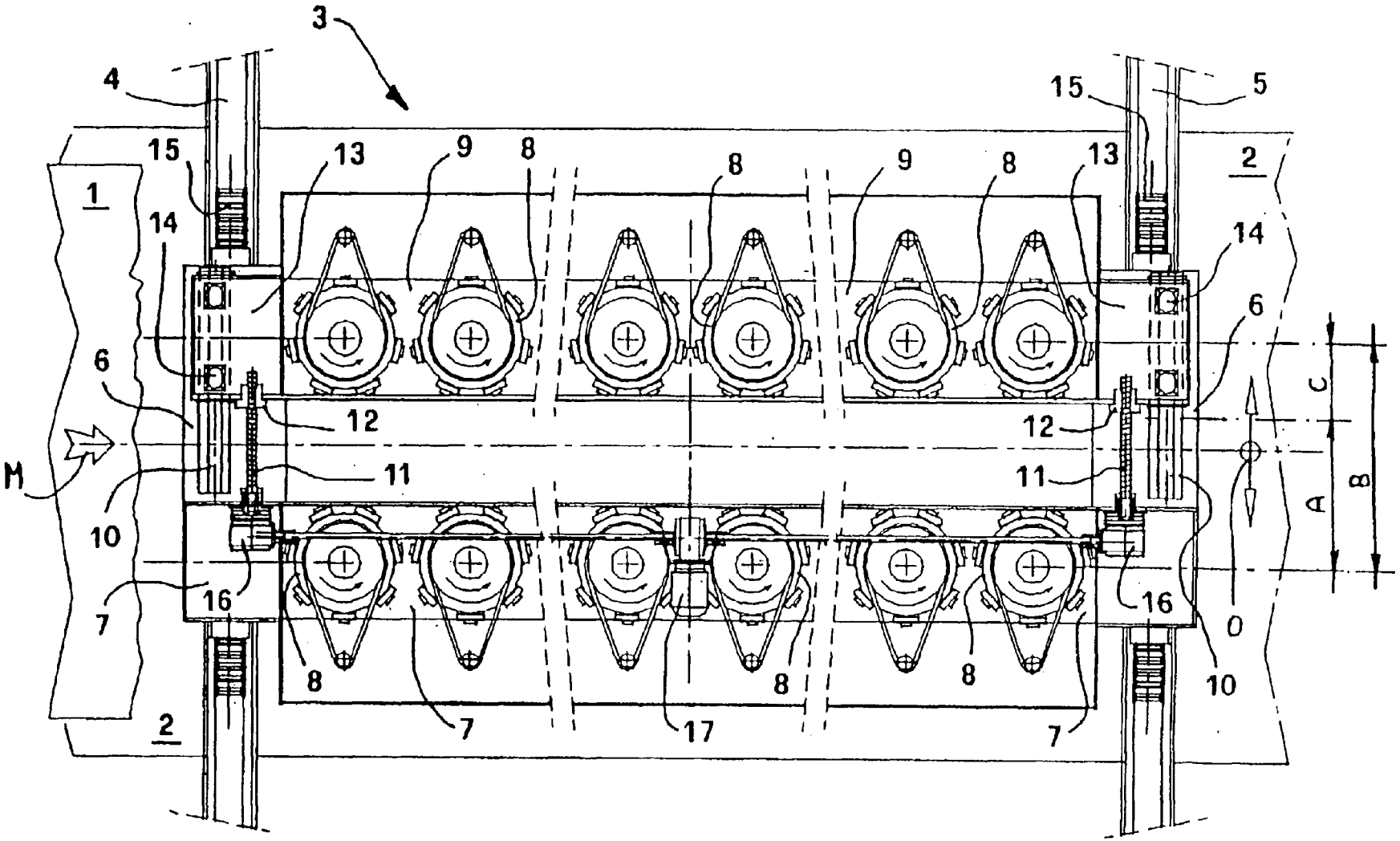
FIG. 1 is a schematic plan view of the polishing machine according to the invention with the two beams carrying the multiple heads.

The figures show: 1, FIG. 1, the slab of stone material being polished, advanced with motion M by means of the conveyor 2 in the working area of the polishing machine 3; 4 and 5, the 2 fixed frames transverse to the said conveyor 2 on which moves the shuttle 6 of the first longitudinal beam 7, equipped with the multiple polishing heads 8; 9, a second beam adjustable parallel to the first beam by means of movement along the guides 10 of the shuttle 6: it has polishing heads 8 analogous to those of the first beam, with the heads aligned transversely to the conveyor having abrasive elements giving the same degree of finishing; 11, the adjusting screws of the distance B between the polishing heads 8 of the respective beams 7 and 9, which couple with corresponding counter-screws 12 on the opposite beam; 13, the extremity of the second beam 9 coupled so that it may translate along the guides 10: braking devices 14 are fixed to the said extremity 13 in sufficient number to counter the forces generated between the two parallel beams during operation; 15, the rollers of the shuttle on the corresponding fixed frames; 16, the drive line from the motor 17 to the said screws 11; O, the oscillating motion of the shuttle 6 with the beams and the corresponding polishing heads, obtained with a known mechanism, not shown; A, the minimum distance between the heads positioned on the two parallel beams and C, the adjustment amplitude of the distance B between them.

Figure 2:
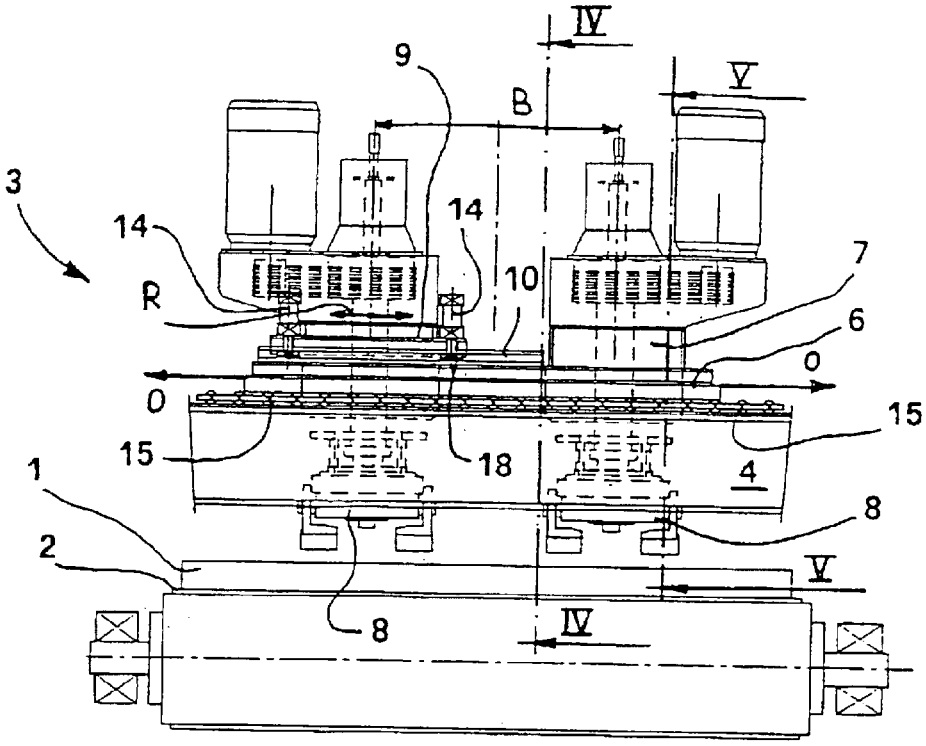
FIG. 2 is the schematic view transverse to the conveyor of the oscillating shuttle with the two beams one of which is adjustable with respect to the other.
Figure 3:
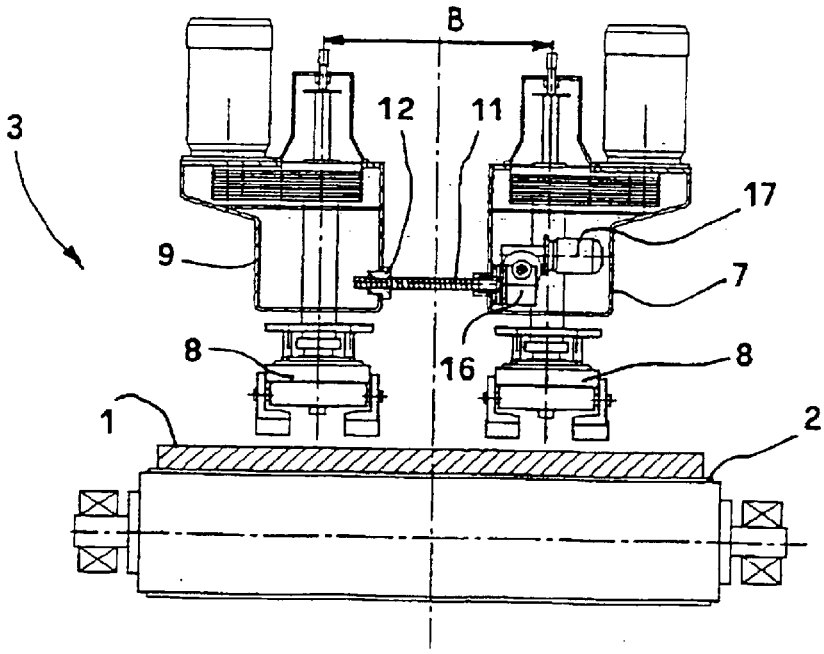
FIG. 3 is a section transverse to the conveyor of the two beams with the distance adjusting mechanism.
Figure 4:
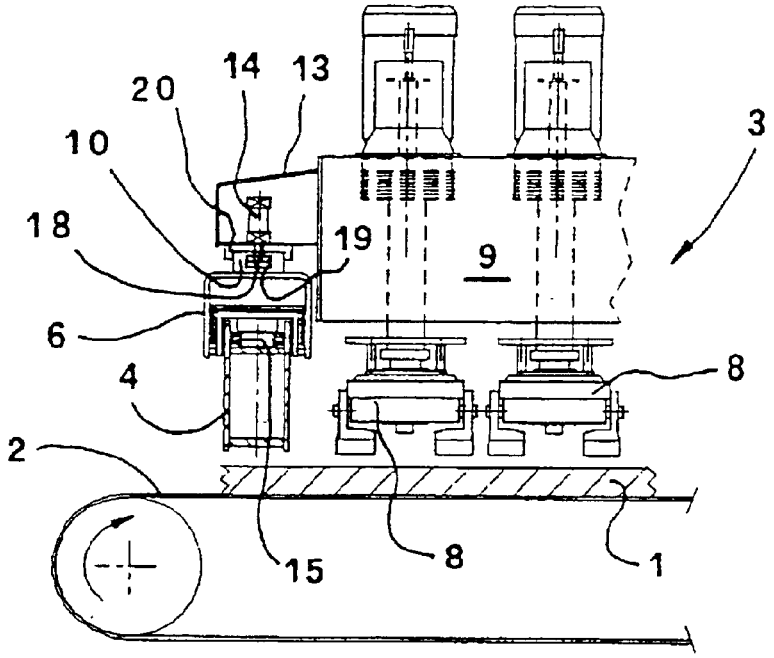
FIG. 4 is the schematic section IV—IV of FIG. 2, showing one extremity of the adjustable beam.
Figure 5:
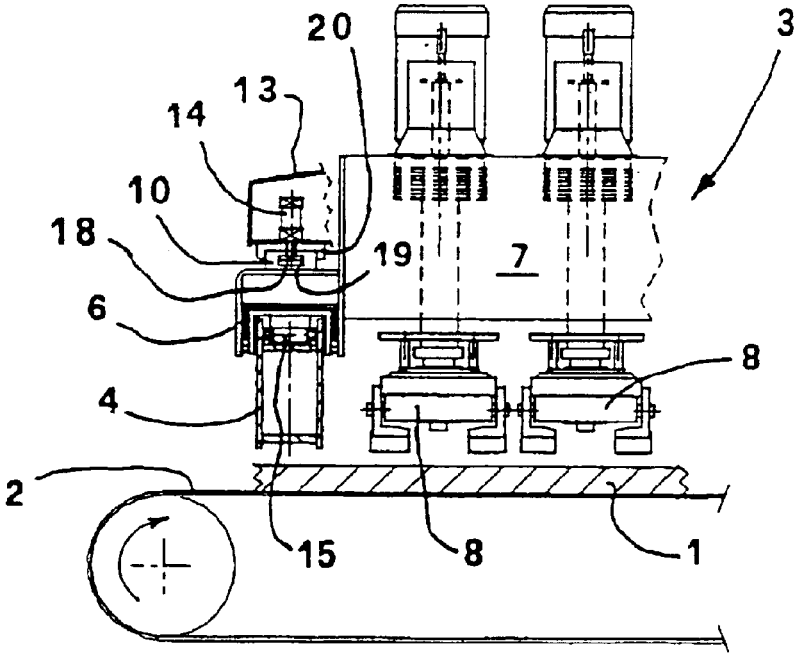
FIG. 5 is the schematic section V—V of FIG. 2, showing one extremity of the beam with the transverse oscillating shuttle.

The figures also show: 18, FIG. 2 the braking mechanism blocking the movement R of the second beam 9 on the guides 10; 19, FIG. 4, the indent in the guide 10 in which the brakes 18 are positioned; 20 the mobile cursor connected to the extremities 13 of the said second beam 9 and coupled to translate on the guide 10 for the adjustment of the distance B between the polishing heads 8.

Operation of the polishing machine according to the invention is as follows.

The stone material 1 enters into the working area of the polishing machine 3 by means of the conveyor 2 in a known manner. A device for detecting the shape of the slab or strip is usually positioned upstream to measure the width to be machined and to electronically control the working cycle of the polishing machine in a known manner. The width measured in this polishing machine may be used, as well as for adjusting the amplitude of oscillation O and for lifting the heads where there is no slab, also for adjusting the distance B between the two beams 7 and 9 with multiple polishing heads 8.

In fact, the electronic control may calculate the distance B and the amplitude of oscillation O, from the width of the slab L, the position of the slab on the conveyor 2, from the extension of the heads 8 from the side of the slab or strip 1, from the working diameter of the heads 8 and from the overlap of the working area on the slab as each head 8, in its oscillating motion, reaches the contiguous working area of the corresponding head of the first beam 7 and the second beam 9. The value of the said overlap is a known function of the working radius of the polishing head 8.

The positioning of the second beam 9 with respect to the first beam 7 by activating the screw and counter-screw mechanism 11, 12 indicated; once the desired distance has been reached the brakes are activated by means of a suitable control mechanism, advantageously remote control, thereby blocking the motion of the second beam with that of the first beam. The said brakes may be mechanical, manually operated, or hydraulic, pneumatic or electrical, suitably dimensioned to counter the forces between the said beams. The braking action of the said brakes may applied externally to the guides 10, but always between an element attached to the first beam 7 and an element attached to the second beam 9 to ensure the locking of the two beams after the adjustment of the distance B between the heads 8.

In their oscillating motion the two beams with the heads 8 travel a distance which is less than half the width of the slab or strip being machined, whereas with the heads arranged on a single beam the heads travel a distance which is almost the entire width of the slab or strip 1, diminished only to avoid an excessive extension beyond the edge of the slab of the abrasive elements, scrapers or rollers in order to avoid damaging them.

The grinding and/or polishing is thereby achieved by moving the slabs or strips 1 along the conveyor 2 into the working area, between the fixed frames 4 and 5 of the said machine 3. The degree of finishing depends on the grading of the abrasive elements chosen and their sequential arrangement.

Finally, the reduced amplitude of oscillation enables a higher oscillation frequency to be employed: thereby the productivity of the machine, already having a reduced overall longitudinal dimension, is considerably increased also with an increase in the speed of advancement of the slabs on the conveyor 2.

In a second embodiment, not shown, the grinding and/or polishing machine may be obtained with the two beams supported so that they may translate even on a fixed intermediate frame between the two said frames 4 and 5, to achieve a high number of heads working simultaneously, thereby eliminating the bending and torsional stability problems that may arise with long beams. In this last case it is convenient synchronise the oscillation of the beams, even though they are divided into sections by the said intermediate frame, the sections being rigidly connected to each other and consequently to the braking devices for the adjusting mechanism between the two beams also of the adjacent section.

In a further embodiment, not shown, each of the parallel beams, with the multiple heads aligned transversely, is made to be adjustable on the same oscillating shuttle; the adjustment of the distance B between the multiple heads of each beam may be achieved with reference to the centre of the said intermediate point on the shuttle, by means of analogous adjustment mechanisms already described. In this case both beams, being adjustable, are equipped with braking devices, always locked during machining, as in the first described and illustrated embodiment.

Finally, in a further version, also not shown, the beams may have the corresponding shuttles coupled so as to translate on the transverse frames. By means of the said adjusting devices and braking devices as described in the previous embodiments, it is possible to lock the two beams together and make them oscillate synchronously.

Furthermore, the said braking devices, 14, 18, in all of the embodiments, may be arranged on suitable elements different from the guides 10, that is, without the function of supporting and translating, but just braking, as in the last embodiment described, where each beam has its shuttle that may translate on the transverse frames, whereby the action of the braking devices has to be on suitable elements attached to the corresponding oscillating beams without intervening on the transverse frames.

In practice the materials, the dimensions and details of execution may be different from, but technically equivalent to, those described without departing from the juridical domain of present invention. Even though less advantageous, the braking devices may be omitted, the forces generated between the beams being countered by means of the adjusting mechanism of the distance B between the said heads.

What is claimed is:

1. Polishing machine for stone materials comprising a conveyor belt for slabs or strips to be polished, a beam made to oscillate on at least two transverse, fixed frames above the conveyor, a number of polishing heads, aligned in a row on the beam and oscillating with the beam, a process and control calculator for the polishing machine, wherein it has a second beam positioned parallel to the first beam, also equipped with a number of polishing heads, transversely aligned in a row with the polishing heads of the first beam, and made to oscillate synchronously with it, by means of adjustable coupling devices, that enable a distance between the rows of polishing heads on the first beam and on the second beam to be varied.

2. Polishing machine as claimed in claim 1, wherein it has braking mechanisms, kept in a locked position during work phase, to ensure that a mechanical coupling between the two beams is blocked.

3. Polishing machine as claimed in claim 2, wherein the adjustable coupling devices consisting of at least one pair of screw devices connected to each other and to the respective first and second beams, driven synchronously by transmission.

4. Polishing machine as claimed in claim 3, wherein a shuttle of the first beam is equipped with guide rails for the second beam.

5. Polishing machine as claimed in the previous claim 4, wherein the braking mechanisms act directly on the said guide rails connecting the two beams.

6. Polishing machine as claimed in claim 3, wherein each beam translates and is adjustable with respect to an intermediate point of a shuttle for the transverse oscillation on the frames on which they are supported and blocked, by means of the braking mechanisms, so as to define a precise distance between the rows of polishing heads of the said beams.

7. Polishing machine as claimed in claim 3, wherein both beams are able to translate directly on the said transverse frames on which they are supported; they are blocked with respect to each other by means of the said braking mechanisms acting on elements connected to the respective beams, so as to define a precise distance between the rows of polishing heads of the said beams.

8. Polishing machine as claimed in the previous claim 2, wherein the braking mechanisms are activated by remote control.

9. Polishing machine as claimed in claim 8, wherein the braking mechanisms consisting of at least one hydraulically or pneumatically controlled actuator for each extremity of the beam.

10. Polishing machine as claimed in claim 8, wherein the braking mechanisms consisting of at least one electrically controlled actuator for each extremity of the beam.

11. Polishing machine as claimed in claim 8, wherein a shuttle of the first beam is equipped with guide rails for the second beam.

12. Polishing machine as claimed in the previous claim 11, wherein the braking mechanisms act directly on the said guide rails connecting the two beams.

13. Polishing machine as claimed in claim 8, wherein each beam translates and is adjustable with respect to an intermediate point of a shuttle for the transverse oscillation on the frames on which they are supported and blocked, by means of the braking mechanisms, so as to define a precise distance between the rows of polishing heads of the said beams.

14. Polishing machine as claimed in claim 8, wherein both beams are able to translate directly on the said transverse frames on which they are supported; they are blocked with respect to each other by means of the said braking mechanisms acting on elements connected to the respective beams, so as to define a precise distance between the rows of polishing heads of the said beams.

15. Polishing machine as claimed in claim 2, wherein the braking mechanisms consisting of at least one hydraulically or pneumatically controlled actuator for each extremity of the beam.

16. Polishing machine as claimed in claim 2, wherein the braking mechanisms consisting of at least one electrically controlled actuator for each extremity of the beam.

17. Polishing machine as claimed in claim 2, wherein a shuttle of the first beam is equipped with guide rails for the second beam.

18. Polishing machine as claimed in the previous claim 17, wherein the braking mechanisms act directly on the said guide rails connecting the two beams.

19. Polishing machine as claimed in claim 2, wherein each beam translates and is adjustable with respect to an intermediate point of a shuttle for the transverse oscillation on the frames on which they are supported and blocked, by means of the braking mechanisms, so as to define a precise distance between the rows of polishing heads of the said beams.

20. Polishing machine as claimed in claim 2, wherein both beams are able to translate directly on the said transverse frames on which they are supported; they are blocked with respect to each other by means of the said braking mechanisms acting on elements connected to the respective beams, so as to define a precise distance between the rows of polishing heads of the said beams.

21. Polishing machine as claimed in claim 1, wherein the adjustable coupling devices consisting of at least one pair of screw devices connected to each other and to the respective first and second beams, driven synchronously by transmission.

22. Polishing machine as claimed in claim 21, wherein a shuttle of the first beam is equipped with guide rails for the second beam.

23. Polishing machine as claimed in the previous claim 22, wherein the braking mechanisms act directly on the said guide rails connecting the two beams.

24. Polishing machine as claimed in claim 21, wherein each beam translates and is adjustable with respect to an intermediate point of a shuttle for the transverse oscillation on the frames on which they are supported and blocked, by means of the braking mechanisms, so as to define a precise distance between the rows of polishing heads of the said beams.

25. Polishing machine as claimed in claim 21, wherein both beams are able to translate directly on the said transverse frames on which they are supported; they are blocked with respect to each other by means of the said braking mechanisms acting on elements connected to the respective beams, so as to define a precise distance between the rows of polishing heads of the said beams.

* * * * *